US010472917B2

(12) United States Patent
Garcia et al.

(10) Patent No.: US 10,472,917 B2
(45) Date of Patent: Nov. 12, 2019

(54) SBOP SWARF WIPER

(71) Applicant: NATIONAL OILWELL VARCO, L.P., Houston, TX (US)

(72) Inventors: Sergio Garcia, Houston, TX (US); Chris Johnson, Houston, TX (US); Lydia Mireles, Houston, TX (US); Ali A. Al-Quraishi, Houston, TX (US); Nathan Follett, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 132 days.

(21) Appl. No.: 15/551,676

(22) PCT Filed: Feb. 17, 2015

(86) PCT No.: PCT/US2015/016177
§ 371 (c)(1),
(2) Date: Aug. 17, 2017

(87) PCT Pub. No.: WO2016/133496
PCT Pub. Date: Aug. 25, 2016

(65) Prior Publication Data

US 2018/0030805 A1 Feb. 1, 2018

(51) Int. Cl.
*E21B 33/08* (2006.01)
*E21B 33/06* (2006.01)

(52) U.S. Cl.
CPC ..... *E21B 33/08* (2013.01); *E21B 33/06* (2013.01); *Y10T 137/4273* (2015.04)

(58) Field of Classification Search
CPC ..... E21B 33/08; E21B 33/06; Y10T 137/4273
USPC ..... 251/1.1–1.3; 137/242
See application file for complete search history.

(56) References Cited

U.S. PATENT DOCUMENTS 3,744,749 A * 7/1973 Le Rouax ..... E21B 33/062 251/1.3
4,283,039 A * 8/1981 Schaeper ..... E21B 33/06 251/1.2
4,531,580 A * 7/1985 Jones ..... E21B 33/085 166/84.3
4,834,139 A * 5/1989 Fitzgibbons ..... E21B 33/0355 137/614.04
4,951,914 A * 8/1990 Meyers ..... E03F 5/02 220/3.4
5,624,123 A 4/1997 Meyers
(Continued)

OTHER PUBLICATIONS

Intellectual Property Office of Singapore Written Opinion dated Aug. 16, 2018, for Application No. 11201706661P.
(Continued)

*Primary Examiner* — John Bastianelli
(74) *Attorney, Agent, or Firm* — Conley Rose, P.C.

(57) ABSTRACT

A wiper (200*a*) for a blowout preventer having an adapter ring (102*a*) and a piston (104*a*) slideable relative to the adapter ring along an interface can include a base (202) adapted to couple the wiper to the adapter ring and a head (204) coupled to the base. The head can include a first portion adapted to bridge the interface and contact the piston and a second portion adapted to contact the adapter ring and support the first portion. The second portion of the head can be adapted to at least partially resist rotation of the wiper. A blowout preventer can include one or more wipers as shown and described.

21 Claims, 6 Drawing Sheets

(56) References Cited

U.S. PATENT DOCUMENTS

| | | | | |
|---|---|---|---|---|
| 6,494,466 | B1 * | 12/2002 | Hartman | F16J 15/025 251/305 |
| 8,403,290 | B2 | 3/2013 | Delbridge | |
| 2002/0056825 | A1 * | 5/2002 | Hartman | F16K 1/2285 251/315.01 |
| 2004/0188949 | A1 * | 9/2004 | Foote | E21B 33/062 277/549 |
| 2012/0118559 | A1 | 5/2012 | Li | |

OTHER PUBLICATIONS

European Patent Office Examination Report dated May 31, 2018, for Application No. 15707027.7.
International Search Report and Written Opinion dated Nov. 16, 2015 for International Patent Application No. PCT/US2015/016177, filed Feb. 17, 2015.

* cited by examiner

SBOP SWARF WIPER

CROSS-REFERENCE TO RELATED APPLICATIONS

This application is a 35 U.S.C. § 371 national stage application of PCT/US2015/016177 filed Feb. 17, 2015, and entitled "SBOP SWARF WIPER," which is incorporated herein by reference in its entirety for all purposes.

FIELD OF INVENTION

The embodiments disclosed herein relate generally to performing well site operations, and more specifically relate to wipers for blowout preventers.

BACKGROUND OF INVENTION

Oilfield operations may be performed to locate and recover downhole fluids, such as oil and gas. Oil rigs can be positioned at well sites, and downhole tools or other drilling tools can be deployed into the ground to reach subsurface reservoirs. Once the downhole tools form a wellbore to reach a desired reservoir, casings may be placed within the wellbore and the wellbore completed to initiate production of fluids from the reservoir. Downhole tubular devices, such as pipes, downhole tools, casings, coiled tubing, or other tubular members, and associated components, such as drill collars, tool joints, drill bits, logging tools, packers and the like (which can be referred to as "tubulars" or "tubular strings") may be positioned in the wellbore for allowing the passage of subsurface fluids to the surface. Leakage of subsurface fluids from a wellbore may pose an environmental threat or other undesirable circumstances. Equipment, such as blow out preventers ("BOPs"), which can include annular or spherical BOPs ("SBOPs"), may be positioned about the wellbore to form a seal about a tubular to selectively prevent leakage of fluid as it is brought to the surface. U.S. Pat. No. 4,283,039, entitled Annular Blowout Preventer With Upper And Lower Spherical Sealing Surfaces, purports to disclose one of many annular blowout preventers for use on an oil or gas well. U.S. Pat. No. 8,403,290, entitled Wiper Seal Assembly, purports to describe another of many hydraulically-operated annular blowout preventers for controlling a wellbore and comprising a wiper seal assembly.

BOPs may have selectively operable components, such as pistons or valves, that may be activated to seal and/or sever a tubular in a wellbore. BOPs may include components that wear out or degrade over time, which can cause a BOP not to perform as desired or even to fail. In some cases, contamination of a BOP's hydraulic fluid system, such as by fluid and/or debris from a wellbore, can cause or contribute to reduced performance or failure. Accordingly, it can be desirable to prevent or at least minimize such contamination in order to help ensure proper functionality of BOPs. Various types of pressure seals can be used to provide a physical separation between the fluids in a hydraulic fluid chamber of a BOP and the fluids or other materials in the central bore or bore chamber of a BOP. However, pressure seals can be subject to damage and degradation over time, which may result from exposure to wellbore fluid. As a result, various types of wiper seals (aka wipers or swarf wipers) can be used to help prevent or minimize exposure of pressure seals or other components to wellbore fluid.

The present disclosure is directed to improved wipers for at least partially minimizing exposure of pressure seals or other components to wellbore fluids and to BOPs including the same.

DETAILED DESCRIPTION OF DISCLOSED EMBODIMENTS

As an initial matter, it will be appreciated that the development of an actual, real commercial application incorporating aspects of the disclosed embodiments will require many implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would nevertheless be a routine undertaking for those of skill in this art having the benefits of this disclosure. It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the disclosure. Unless otherwise indicated, the terms "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and can further include without limitation integrally forming one functional member with another in a unity fashion. Coupling can occur in any direction, including rotationally. The terms "including" and "such as" are illustrative and not limitative.

Figure 1:
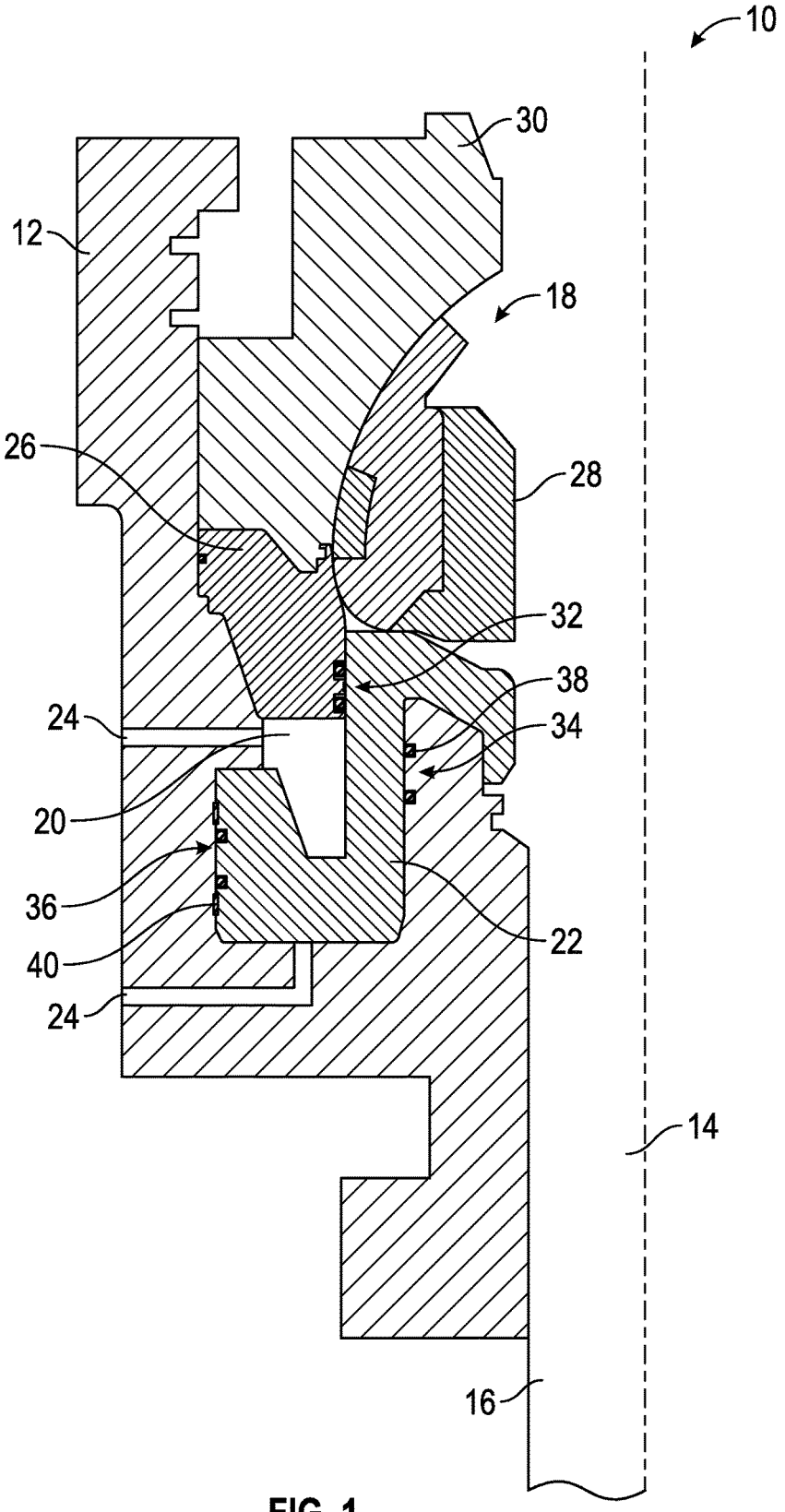
FIG. 1 (Prior Art)
FIG. 1 is a partial cross-sectional view of one of many conventional BOPs.

FIG. 1 is a partial cross-sectional view of one of many conventional BOPs. Numerous BOPs, including SBOPs and other BOPs (e.g., ram BOPs), are known in the art, the components and operations of which need not be described in detail herein. However, for purposes of background and context, FIG. 1 illustrates a portion of one of many conventional SBOPs for which one or more of the embodiments of the present disclosure can be used. A BOP 10, such as a hydraulically operated annular BOP, generally can comprise a body (or housing) 12 for housing one or more other BOP components with a bore 14 extending there through. The bore 14 can be an extension of, and can communicate with, a wellbore 16. BOP 10 can include one or more chambers or cavities, such as a bore chamber 18 for receiving well fluid and a hydraulic fluid chamber 20 for containing hydraulic fluid used to operate one or more components of the BOP. For example, hydraulic fluid chamber 20 may receive fluid for moving a piston 22 among two or more positions within the BOP, such as from one or more fluid ports 24. BOP 10 can include one or more additional components that support or communicate with piston 22, which components can differ depending on the type or configuration of a BOP at hand. As shown in the example of FIG. 1, a BOP 10 can include an adapter ring 26 at least partially disposed between body 12 and piston 22, and various other BOP components, such as a packer 28, a top 30, or other parts which need not be shown or described herein, such as access openings, locking components, inserts, pusher plates, vents, fittings, donuts, seals, fasteners and the like. Piston 22 can slide or otherwise move relative to one or more other BOP components during operation (e.g., opening or closing) of the BOP. For instance, piston 22 can slide relative to adapter ring 26 or body 12, which can include communicating with such components in one or more locations, such as at or along an interface 32 between piston 22 and adapter ring 26 or interfaces 34, 36 between piston 22 and body 12. BOP 10 can include one or more wear components 38, 40, which can include components for supporting motion, sealing or wear prevention along interfaces between parts. Examples of such components can include rod seals, buffer seals, wear rings, piston seals, or as other examples, items such as head seals, O-rings, D-rings and the like. As will be understood by a person of ordinary skill in the art having the benefits of the present disclosure, it is the protection of these and other wear components with which the embodiments of the present disclosure are concerned.

This disclosure provides systems and methods for at least partially minimizing or preventing wellbore fluids, including any particles, contaminants or other materials therein (collectively "well fluid(s)"), from passing into one or more portions of a BOP, such as an SBOP. As used herein, terms such as "prevent," "minimize" and like terms can include complete or total prevention or minimization, but need not, and are intended to encompass partial prevention or minimization as well. Further, it will be understood that degrees of prevention and minimization can, and likely will, differ between embodiments and change over time, such as due to wear or degradation of components and materials over a period of use. In at least one embodiment, a wiper, such as a swarf wiper or wiper seal, can be coupled to a BOP for preventing the passage of well fluid to one or more components, such as between two or more components wholly or partially disposed within a housing of the BOP. For example, a wiper can be arranged and disposed for preventing well fluid from passing into an area between a stationary BOP component and movable BOP component, such as a piston that moves relative to one or more other components of a BOP. As other examples, a wiper can be arranged and disposed for preventing or shielding well fluid from contacting one or more seals, wear rings or other wear components, for redirecting well fluid away from one or more BOP components, or for at least partially confining well fluid to a bore or space within a BOP. In at least one embodiment, a wiper can be arranged and disposed for wiping a BOP component or portion thereof, which can include cleaning, scraping, sliding against, sealing with, or otherwise contacting the component, separately or in combination, in whole or in part. As another example, wiping a BOP component can include at least partially removing one or more substances or materials therefrom, such as well fluid, dirt, debris, formation materials or swarf. One or more embodiments of the present disclosure will now be described in greater detail with reference to the figures.

Figure 2:
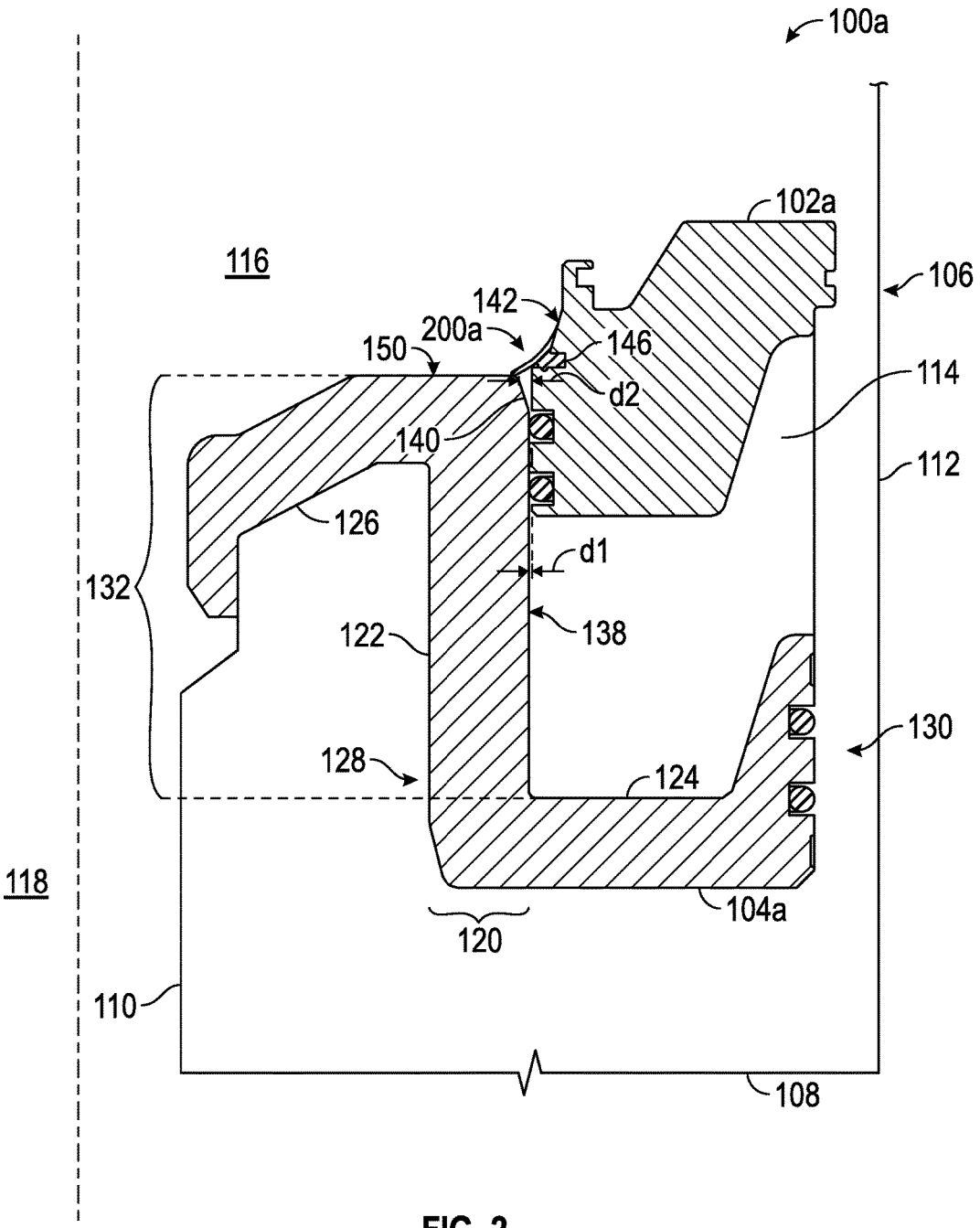
FIG. 2 is a partial cross-sectional view of one of many embodiments of a BOP according to the disclosure.
Figure 3:
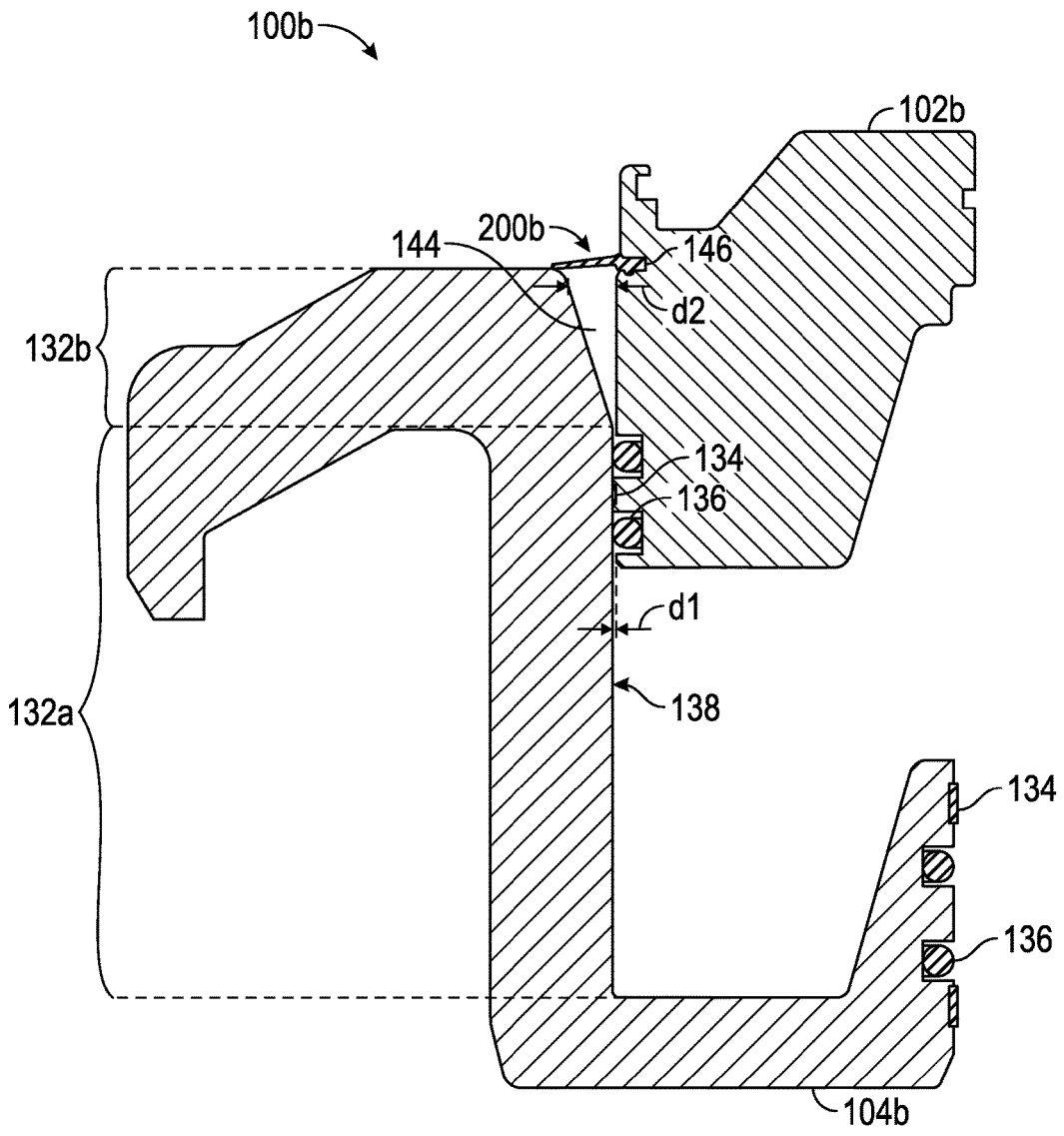
FIG. 3 is a partial cross-sectional view of another of many embodiments of a BOP according to the disclosure.
Figure 4:
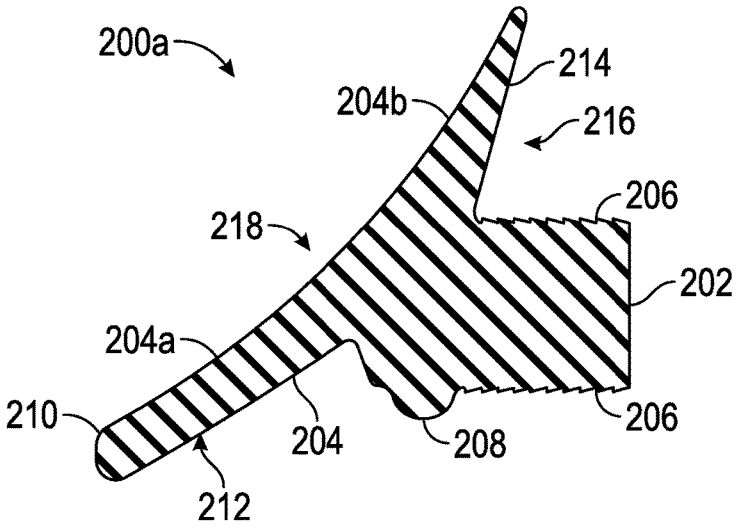
FIG. 4. is a cross-sectional view of one of many embodiments of a wiper according to the disclosure.
Figure 5:
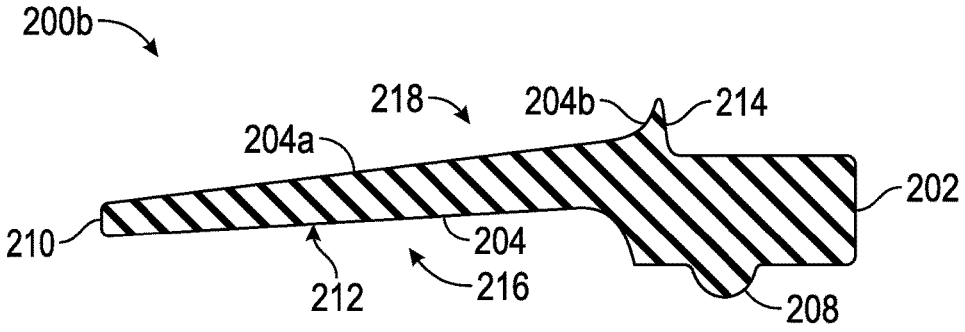
FIG. 5 is a cross-sectional view of another of many embodiments of a wiper according to the disclosure.
Figure 6:
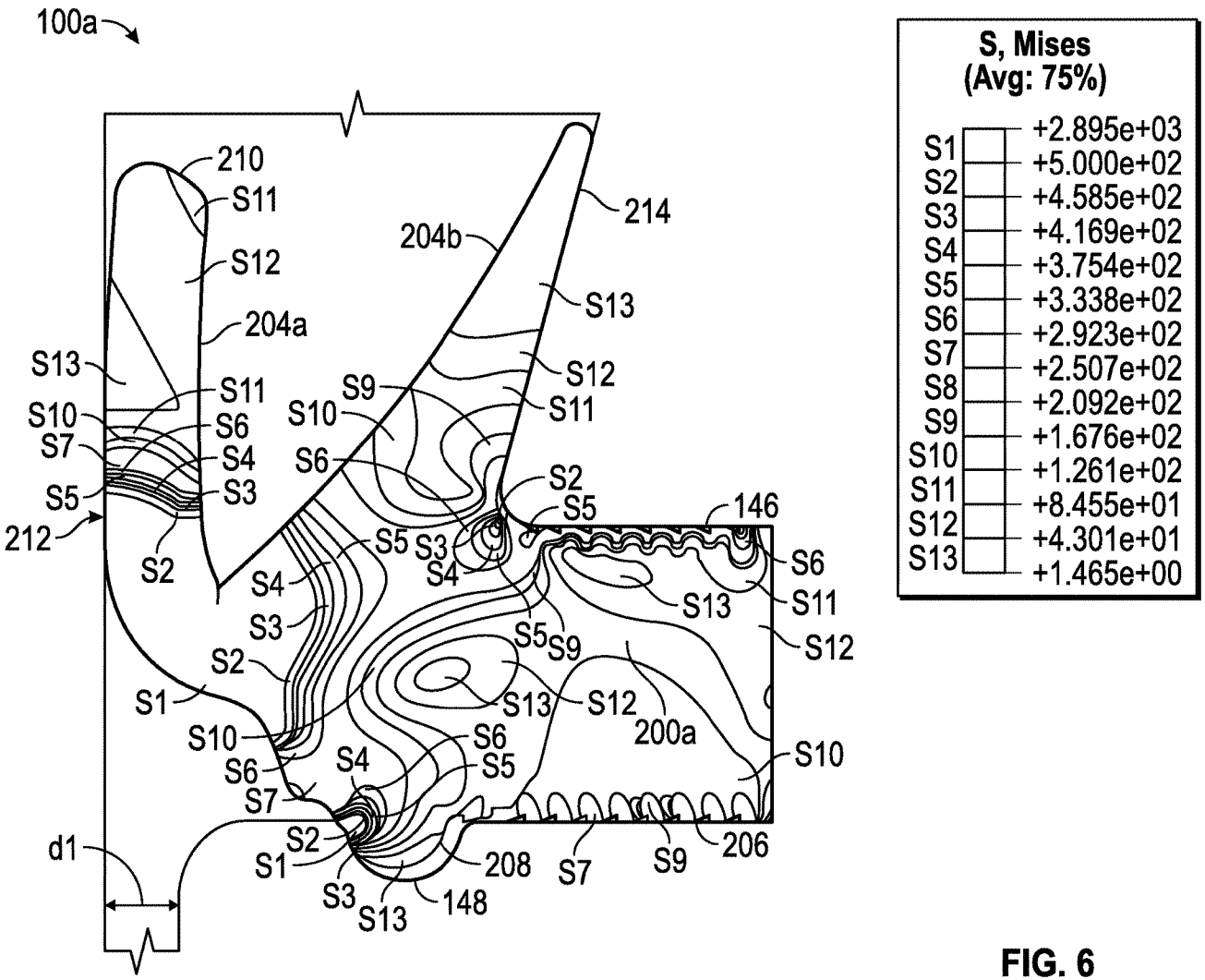
FIG. 6 is an example stress analysis of the wiper of FIG. 4.
Figure 7:
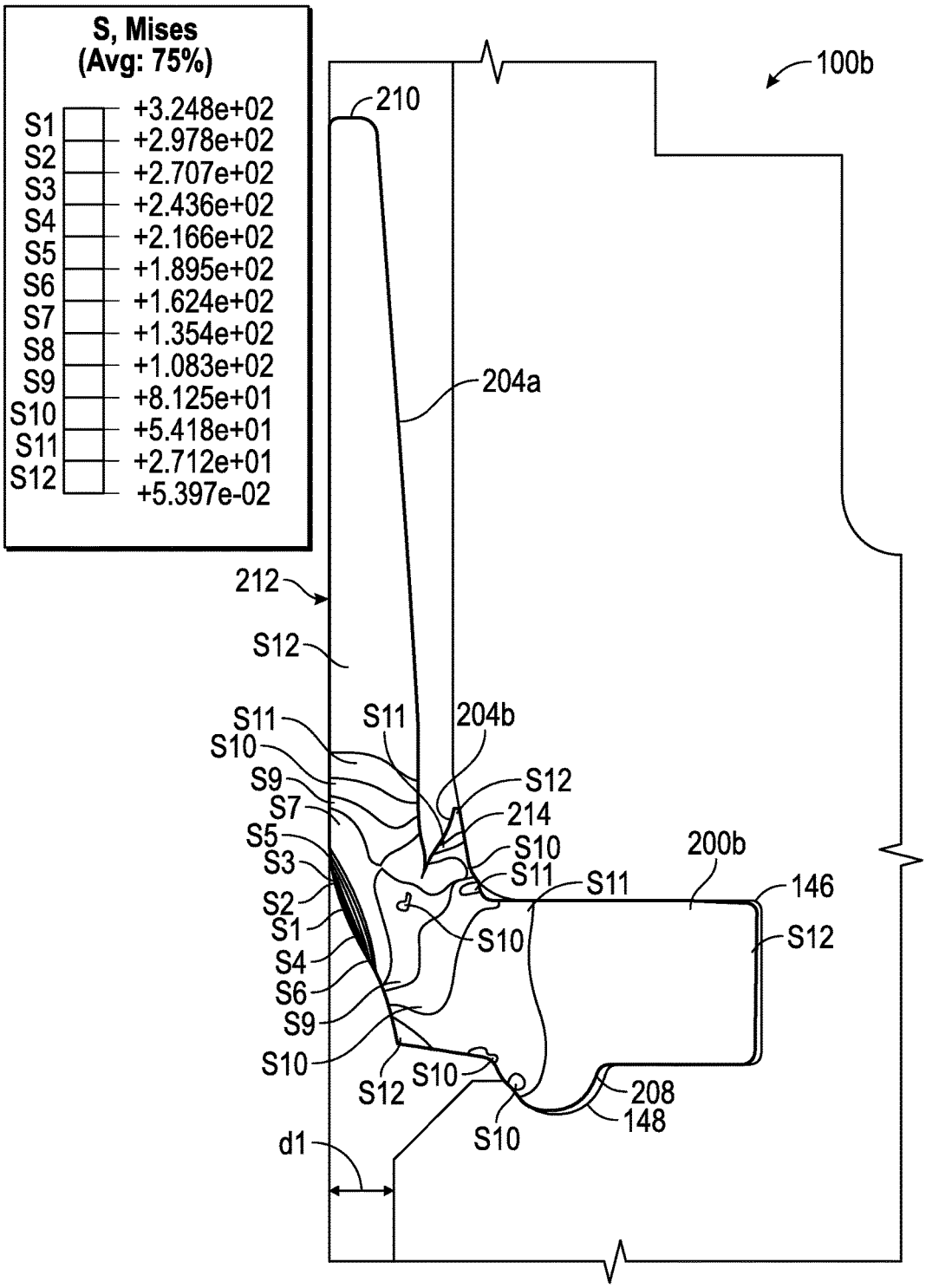
FIG. 7 is an example stress analysis of the wiper of FIG. 5.

FIG. 2 is a partial cross-sectional view of one of many embodiments of a BOP according to the disclosure. FIG. 3 is a partial cross-sectional view of another of many embodiments of a BOP according to the disclosure. FIG. 4. is a cross-sectional view of one of many embodiments of a wiper according to the disclosure. FIG. 5 is a cross-sectional view of another of many embodiments of a wiper according to the disclosure. FIG. 6 is an example stress analysis of the wiper of FIG. 4. FIG. 7 is an example stress analysis of the wiper of FIG. 5. FIGS. 2-7 will be described in conjunction with one another. In at least one embodiment, a BOP can include one or more wipers for wiping well fluid or other substances from one or more components of the BOP, separately or in combination, in whole or in part. Alternatively, or collectively, a wiper(s) can at least partially minimize or prevent well fluids from reaching a space within a BOP or from coming in contact with a component(s) of a BOP, as further described below.

As shown in the exemplary embodiments of FIGS. 2-3, which are but two of many, a BOP, such as BOPs 100*a*, 100*b*, can include one or more stationary components, such as adapter rings 102*a*, 102*b*, and one or more moveable components, such as pistons 104*a*, 104*b*, adapted to move relative to the stationary component(s) for controlling fluid flow. As explained in more detail below, while BOP 100*a* and BOP 100*b* (and their respective components) can be similar in some respects, they can differ in other respects. Accordingly, BOP 100*a* and BOP 100*b* (and their respective components, e.g., adapter rings 102*a*, 102*b*; pistons 104*a*, 104*b*, etc.) may be referred to separately in some portions of the present disclosure and collectively as BOP 100 (or, e.g., adapter ring 102, piston 104, etc.) in other portions of the disclosure. Otherwise, like reference numerals generally are used for like components, which components can, but need not, be identical in one or more structural or functional respects.

In at least one embodiment, piston 104 can be slideably coupled to adapter ring 102 (and/or one or more other components of BOP 100) for sliding up and down (in the illustrative orientation of FIGS. 2-3) among a plurality of positions. In at least one embodiment, piston 104 can have a fully open position (e.g., as shown in FIGS. 2-3) for allowing fluid flow through BOP 100, a fully closed position for preventing fluid flow through BOP 100 and a plurality of interim positions. Adapter ring 102, piston 104 and other BOP components can be housed (in whole or in part) within a housing 106, such as an annular housing or other body, for holding the various components and otherwise supporting overall operation of the BOP, which can be any type or size BOP according to an implementation at hand. Housing 106 can include a base wall 108 and inner and outer, radially spaced apart, upwardly projecting walls 110, 112. Walls 108, 110 and 112 can cooperate to form all or part of one or more chambers or spaces within BOP 100, such as a hydraulic fluid chamber 114 for supporting actuation of piston 104 and a bore chamber 116 for fluidicly communicating with a wellbore 118.

Adapter ring 102 can be coupled with outer wall 112 and can project radially inwardly to at least partially enclose hydraulic fluid chamber 114, such as by forming an upper portion thereof. BOP 100 can include a gap between inner wall 110 and adapter ring 102, such as an annular gap 120 in which piston 104 can be at least partially disposed. Piston

104 can be slideably disposed within chambers 114, 116, and can include a vertically extending wall 122, an outwardly projecting lip 124 at a lower end of wall 122 and an inwardly projecting lip 126 at an upper end of wall 122. Lip 124 can be slideably positioned within hydraulic fluid chamber 114, lip 126 can be slideably positioned within bore chamber 116 and wall 122 can extend through gap 120 there between. BOP 100 can include one or more interfaces, such as wholly or partially sealed or sealable interfaces, for communication between two or more components. For example, BOP can include an interface 128 between or among vertical wall 122 of piston 104 and inner wall 110 of housing 106 and an interface 130 of lip 124 and outer wall 112, such as for moving communication between piston 104 and housing 106 and/or for at least partially isolating fluid in hydraulic fluid chamber 114 from well fluid and/or other material in bore chamber 116. Additionally, or separately, BOP 100 can include an interface 132 for supporting sliding communication of piston 104 relative to adapter ring 102 and/or for at least partially sealing gap 120.

BOP 100 can include wear components for supporting relative movement of one or more components, such as one or more of the wear components described elsewhere herein (e.g., wear pads, wear rings, seals and the like). As shown in the illustrative embodiment of FIGS. 2-3, for example, BOP 100 can include one or more wear rings 134 and one or more pressure seals 136 for supporting sealing and sliding communication along respective interfaces of two or more adjacent components. Such wear components can be of any type and number according to an implementation or kind of BOP, and can be coupled to any component(s) as may be appropriate under the circumstances. As will be understood by a person of ordinary skill having the benefits of the present disclosure, the form, location and number of wear components shown and described herein are for illustrative purposes, and the foregoing factors can, and likely will, vary among BOPs and related implementations or applications.

In at least one embodiment, BOP 100 can include one or more wipers 200 for supporting communication, such as sliding, sealing or other communication, between two or more BOP components. As shown in FIG. 2, for example, BOP 100*a* can include a wiper 200*a* coupled with adapter ring 102*a* for wiping or otherwise protecting at least a portion of interface 132, such as surface 138 of piston 104*a*, which can, but need not be a radially outside surface. As shown in FIG. 3, as another example, BOP 100*b* can include a wiper 200*b* coupled with adapter ring 102*b* for wiping or otherwise protecting at least a portion of interface 132, such as surface 138 of piston 104*b*, which can, but need not be a radially outside surface. For instance, wiper 200 can wipe surface 138 or a portion thereof as piston 104 moves up and/or down relative to adapter ring 102 during actuation of BOP 100 for controlling fluid flow there through, which can include at least partially removing or redirecting well fluid or other substance(s) (e.g., from bore chamber 116) from a portion of piston 104 in contact with wiper 200. Alternatively, or collectively, wiper 200 can at least partially seal against piston 104 for reducing or preventing well fluid from reaching interface 132, such as by skimming or squeegeeing well fluid from surface 138 as piston 104 moves toward base wall 108 of housing 106. As another example, wiper 200 can at least partially prevent well fluid from contacting one or more wear components coupled fluidicly between bore chamber 116 and hydraulic fluid chamber 114, such as wear rings 134, pressure seals 136 or other components coupled to wear ring 102 or piston 104. Of course, it will also be appreciated that wiper 200 can at least reduce or slow damage to, or degradation of, piston 104 or adapter ring 102, such as by preventing marring or scoring due to the presence of well fluid (including any particles or contaminants therein) in interface 132 as piston 104 moves relative to adapter ring 102.

In at least one embodiment, which is but one of many, BOP 100 can include an interface 132 that varies along its length, such as by exhibiting a change in size or shape, which can be due to, e.g., the geometry of one or more components that meet or otherwise cooperate along the interface. For example, as shown in the embodiments of FIGS. 2-3 for illustrative purposes, piston 104 (or another component) can include a modified corner 140, such as a corner that has been filleted, chamfered, rounded, ground, reduced or otherwise modified, or another feature resulting in one or more changes in dimension along an interface. As another example, as shown in the embodiment of FIG. 2 for illustrative purposes, one or more surfaces of a component(s), such as surface 142 of adapter ring 102, can diverge from or otherwise change relative to another component (e.g., piston 104), which can result in a change in distance between components along an interface. In such embodiments, which are but some of many, interfaces between communicating, cooperating, adjacent or other components can include a plurality of different interface portions. For instance, interface 132 can include two or more interface portions, such as a first interface portion 132*a* wherein piston 104 and adapter ring 102 are separated by a first distance d1 (which can be any distance) and a second interface portion 132*b* wherein piston 104 and adapter ring 102 are separated by a second distance d2 different from (i.e., greater or less than) the first distance, or as another example, wherein the size or volume of a gap 144 between piston 104 and adapter ring 102 changes over a length of the interface portion (see FIG. 3). Each of first and second distances d1, d2 can, but need not, include a plurality or range of distances. Varying interfaces, such as those described above, can be present in many different BOPs, and for any of numerous reasons. For example, reduced corners or edges, or diverging component surfaces, can be desirable for supporting operation of a BOP, such as by providing for easier assembly or helping to ensure proper movement of a piston relative to other components during BOP actuation. However, as can be seen from the example embodiments of FIGS. 2-3, attributes of this nature can present a relatively larger space (see, e.g., gap 144 versus an interface distance along interface portion 132*a*) to bore chamber 116, which can result in an increased likelihood of well fluids reaching an interface of two or more components and/or components subject to wear along an interface, such as interface 132, wear rings 134, seals 136 and the like. In at least some BOPs or other devices wherein an interface between two components or surfaces includes a gap that is not uniform along at least a portion of the interface (see, e.g., FIGS. 2-3), one or more embodiments of the wipers disclosed and taught herein can provide improved wiping as compared to conventional wipers. For instance, in an embodiment such as BOPs 100*a*, 100*b*, which are but two of many, the wear components (e.g., wear rings 134, pressure seals 136) can be of a size(s) (e.g., cross-sectional dimension or area) sufficient to bridge the space or distance between adapter ring 102 and piston 104 along one or more interface portions (e.g., interface portion 132*a*), but insufficient to bridge the larger space or distance between adapter ring 102 and piston 104 along one or more other interface portions (e.g., interface portion 132*b*). In such an embodiment, wiper 200 can be of a size sufficient to bridge the space or distance between adapter ring 102 and piston 104 along at least a portion of the larger or largest of one or more interface portions (e.g., interface portion 132*b*), such as an interface portion across which one or more wear components cannot reach. Further, wiper 200 can, but need not, also be adapted to wipe or otherwise fit along at least a portion of the smaller or smallest of one or more interface portions (e.g., interface portion 132*a*), such as an interface portion across which one or more wear components can reach, as further explained below.

With continuing reference to FIGS. 2-3 and particular reference to FIGS. 4-7, wipers 200*a*, 200*b* (collectively referred to herein as wiper 200) can include a base 202 for coupling wiper 200 to one or more BOP components and a head 204 for wiping one or more BOP components and for otherwise supporting wiper 200. Base 202 can be or include a male coupler adapted to couple with a female coupler (e.g., a groove or other receiver) of one or more components of BOP 100, such as adapter ring 102. Of course, this need not be the case, and alternatively, or collectively, base 202 can be or include a female coupler adapted to couple with a male coupler of one or more components of BOP 100. As shown in the example embodiments of FIGS. 2-7 for illustrative purposes, base 202 can be shaped and sized to be at least partially disposed in an annular peripheral groove 146 of adapter ring 102 or another portion of BOP 100, which can be any portion or component of BOP 100 according to an embodiment or implementation. Base 202 can, but need not, include one or more projections 206, such as extensions, nubs, teeth, barbs, serrations or other structures, for coupling wiper 200 to adapter ring 102. For example, projections 206 can be or include elastically or plastically deformable structures for compressing between base 202 and groove 146 and resisting uncoupling of wiper 200 from, or movement of wiper 200 relative to, a BOP component or coupler thereof. Wiper 200 can be coupled to BOP 100 in any manner according to a particular application, such as by force fit, friction fit or interference fit, separately or in combination, in whole or in part. As other examples, alternatively or collectively with any of the foregoing examples, wiper 200 can be annular or ring-shaped, base 202 can have an inside or other dimension, such as a diameter, that is equal to or less than a dimension of a BOP component to which it may be coupled (e.g., adapter ring 102 or groove 146). In such an embodiment, wiper 200 can be stretched about a BOP component and at least partially held in place by elastic force. Optionally, wiper 200 can be coupled to BOP 100 by way of one or more couplers, such as retainers, fasteners, adhesives and the like, separately or in combination, in whole or in part. In at least one embodiment, wiper 200 can include one or more protrusions 208, such as extensions, nubs, or other structures, for coupling wiper 200 to a BOP component, which can include resisting uncoupling of wiper 200 from, or movement of wiper 200 relative to, a BOP component or coupler thereof. For example, a BOP component can include one or more couplers 148, such as an opening, groove, slot, or other structure, and protrusion 208 can be or include structure for mating with coupler 148, such as elastically or plastically deformable or other structure. As shown in the example embodiments of the figures, coupler 148 can be or include a groove in fluid communication with at least a portion of groove 146, and protrusion 208 can be shaped and sized to fit at least partially within coupler 148. However, this need not be the case, and alternatively, or collectively, protrusion 208 can be a channel or other female coupler and coupler 148 can be an extension or other male coupler for coupling with protrusion 208, separately or in combination. Protrusion 208 and coupler 148 can be of any size or shape according to a particular implementation or application.

In at least one embodiment, head 204 can include a first portion 204*a* for wiping, which can, but need not, include forming at least a portion of a seal between two or more portions of BOP 100. First portion 204*a* can be adapted to wipe one or more components of BOP 100, such as by contacting, scraping, at least partially sealing with, or otherwise wiping piston 104. Alternatively, or collectively, first portion 204*a*, separately or in combination with a second portion 204*b* (described below), can be adapted to at least partially separate bore chamber 116 and hydraulic fluid chamber 114. First portion 204*a* can bridge or extend at least partially across interface 132 for contacting piston 104 along its interface with adapter ring 102, which can include contacting piston 104 at any position or series of positions along interface 132, continuously, intermittently or otherwise. For example, first portion 204*a* can contact surface 138 of piston 104 along first interface portion 132*a*, a surface along second interface portion 132*b*, such as a surface of modified corner 140, or another portion of piston 104, such as an upwardly facing surface 150. First portion 204*a* can contact or wipe a BOP component with any surface(s) or other portion(s) according to an implementation at hand and, in at least one embodiment, first portion 204*a* can include a plurality of contact portions for wiping different parts of piston 104 or another BOP component. For instance, first portion 204*a* can include a tip 210 for wiping surface 150 or modified corner 140, separately or in combination, in whole or in part. As another example, first portion 204*a* can include a bottom surface 212 for wiping one or more other portions of piston 104, such as surface 138 along at least part of interface portion 132*a*. First portion 204*a* can have a length or other dimension, such as a major or cross-sectional dimension, that is greater than or equal to a dimension of a wear component disposed along the same interface of wiper 200. For example, first portion 204*a* can extend far enough to contact piston 104 across at least a portion of gap 144 while nonetheless being configured to wipe at least a portion of piston 104 along first transition portion 132*a*.

In at least one embodiment, head 204 can include a second portion 204*b* for supporting wiper 200, which can, but need not, include forming at least a portion of a seal between two or more portions of BOP 100. For example, second portion 204*b* can be coupled to first portion 204*a* and base 202 for supporting coupling of wiper 200 to a BOP component (e.g., adapter ring 102) during wiping, such as by at least partially resisting rotation of, or providing structural rigidity to, wiper 200 or a portion thereof, separately or in combination, in whole or in part. Second portion 204*b* can include a side 214, such as a surface, wall or other portion, for contacting a component to which wiper 200 may be coupled (e.g., adapter ring 102) and resisting rotation of wiper 200 relative to that component in one or more directions, which can be any direction. As shown in FIGS. 2-3 and 6-7 for illustrative purposes, side 214 can rest against or be forced against surface 142 or another portion of adapter ring 102, and second portion 204*b* can resist rotation in a clockwise direction, such as by counteracting torque about base 202 due to force applied on first portion 204*a*. Of course, this need not be the case and second portion 204*b* can resist rotation in any direction according to a particular implementation or orientation, including counterclockwise. In other words, second portion 204*b* can be shaped and arranged for at least partially increasing a maximum stress to which wiper 200 can be subjected without failing, i.e., while maintaining an ability to at least partially wipe a BOP component or shield against encroachment of well fluid into an interface between two or more components. First and second portions 204*a*, 204*b* can have any lengths, thicknesses, orientations and geometries according to an implementation, which attributes can be the same or different as between the two portions, in whole or in part. For example, in at least one embodiment, first portion 204*a* can have a length that is greater than a length of second portion 204*b*. As another example, side 214 of second portion 204*b* can be disposed at an angle relative to base 202, such as an obtuse angle, an acute angle, or another angle, including orthogonally. As yet another example, head 204 can have two or more sides relative to base 202, such as a proximal side 216 including surface 212 of first portion 204*a* and side 214 of second portion 204*b*, and a distal side 218, which can, but need not, be or include a curved surface, such as an arcuate, bowed, rounded, arched or other non-linear surface.

In at least one embodiment, which is but one of many, wiper 200 can be adapted to at least partially change positions or otherwise move during wiping, which can include one or more portions of wiper 200 flexing or rotating constantly, intermittently or otherwise as a BOP component moves relative to wiper 200, or vice versa, as the case may be. For example, in one BOP position, such as a position in which BOP is partially or fully open (see, e.g., FIGS. 2-3), first portion 204*a* of head 204 can be disposed in a first wiping position in contact with a portion of piston 104. For instance, tip 210 or a portion thereof can be disposed in contact with surface 150 or modified corner 140, and wiper 200 can at least partially prevent well fluid from flowing from bore chamber 116 into interface 132. As BOP 100 is actuated, such as to move piston 104 toward or to another BOP position, e.g., a partially or fully closed position (see, e.g., FIGS. 6-7), piston 104 can move upwardly relative to wiper 200 and tip 210 can slide along second interface portion 132*b*. As piston 104 moves, first portion 204*a* of head 204 can rotate (e.g., clockwise in the example orientation of FIGS. 2-3 and 6-7), and consequently the part of first portion 204*a* in contact with piston 104 can change, as first portion 204*a* rides along the curvature (or other geometric shape) of modified corner 140 or another portion of piston 104 disposed in or along interface portion 132*b*. As wiper 200 approaches a transition to interface portion 132*a*, or during or after wiper 200 reaches interface portion 132*a* (as the case may be according to a particular implementation), first portion 204*a* of head 204 can continue to rotate (including by flexing, bending, deforming and the like) while remaining in contact with piston 104 and while remaining coupled to adapter ring 102. In at least one embodiment, first portion 204*a* can rotate far enough that both tip 210 and surface 212 contact piston 104 (see, e.g., FIG. 7). As another example, first portion 204*a* can rotate far enough that tip 210 at least partially loses contact with piston 104 and surface 212 remains in contact with or otherwise contacts piston 104 (see, e.g., FIG. 6) for wiping a different portion of piston 104, such as a portion of surface 138 along first interface portion 132*a*. Similarly, head 204 can remain in contact with piston 104 as piston 104 moves in one or more other manners, such as in a direction opposite that discussed above, or in another direction from an at least partially closed position to an at least partially open position. Further, as illustrated in FIGS. 6-7, second portion 204*b* of head 204, protrusion 208 and projections 206 can support wiper 200 in coupling relation to adapter ring 102 and wiping relation to piston 104 throughout the foregoing movements and transitions, separately or in combination, in whole or in part. In this manner, wiper 200, in at least one embodiment, can have a relatively flexible wiping portion with a dimension (e.g., a length or major dimension) greater than or equal to a greatest (or other) distance between two BOP components along an interface of the components. For example, in at least one embodiment, first portion 204*a* of head 204 can rotate at least 45 degrees as piston 104 moves from one position to another position relative to wiper 200. In at least one embodiment, first portion 204*a* of head 204 can rotate more than 45 degrees and up to 90 degrees as piston 104 moves from one position to another position relative to wiper 200. In at least one embodiment, first portion 204*a* of head 204 can rotate more than 90 degrees as piston 104 moves from one position to another position relative to wiper 200. Of course, as will be understood by a person of ordinary skill having the benefits of the present disclosure, the terms "one," "another," "first," "second," "third," "open," "closed" and the like, as used above are for purposes of illustration and are not intended as limitative. The various positions and relative locations (if present) can exist or occur in any number or order according to a BOP implementation at hand.

Although wiper 200 can be coupled to a stationary component, such as adapter ring 102 shown and described herein for exemplary purposes, this need not be the case and alternatively, or collectively, one or more wipers 200 can be coupled to one or more dynamic or moveable components, such as piston 104 or another BOP component that moves during actuation of a BOP. Further, wiper 200 can include a series of wipers along a single interface, which can include wipers of the same size, different sizes, or both. Also, one or more wipers 200 can be disposed along any interface of a BOP, which can include interfaces between moving components, non-moving components and combinations thereof. For instance, one or more wipers 200 can be disposed along one or more of interfaces 128 and 130, or any interface according to an application or implementation.

Wiper 200 can be formed in any manner and from any material. For example, a wiper 200 can be a continuous, annular ring, such as an O-ring or otherwise shaped ring for coupling to a BOP or other component. As another example, wiper 200 can be or include one or more segments. Wiper 200 can be formed of plastic, rubber, metal or other materials, separately or in combination, in whole or in part, which can, but need not, include resistant materials suitable for resisting temperatures, pressures, chemicals and other conditions experienced in wellbores and drilling operations. In at least one embodiment, wiper 200 can be formed from a polymer compound. As another example, wiper 200 can be extruded and formed of nitrile rubber having a durometer hardness of at least 70 (Shore A scale), or a greater hardness, such as a hardness in the range of 70-95 (inclusive). Wiper 200, including the individual components thereof, can be formed integrally as a single piece or can be formed separately and coupled together in another manner, separately or in combination, in whole or in part.

In at least one embodiment, a wiper for a blowout preventer having an adapter ring and a piston slideable relative to the adapter ring along an interface can include a base adapted to couple the wiper to the adapter ring and a head coupled to the base. The head can include a first portion adapted to bridge the interface and contact the piston and a second portion adapted to contact an inner or other surface of the adapter ring. The second portion of the head can be adapted to bias the first portion of the head toward the piston. The second portion of the head can be adapted to at least partially resist rotation of the base, such as when force may be applied to the first portion of the head in at least one direction, and the first portion of the head can be adapted to wipe the piston when the piston slides relative to the adapter ring. The second portion of the head can be adapted to at least partially resist separation of the first portion of the head from the piston, such as when force is applied to the first portion in at least one direction. The second portion of the head can be adapted to bias the first portion of the head away from the adapter ring. The second portion of the head can be adapted to bias the first portion of the head toward one or more positions of contact with the piston. The second portion of the head, separately or in combination with one or more other portions of a wiper or BOP component, can be adapted to prevent well fluid or other substances from entering an interface or other area, such as by routing or directing movement of such materials in one or more directions (e.g., toward the top of a piston or other location within a bore chamber). The base can be adapted to couple with an annular peripheral groove of the adapter ring and the base can further comprise one or more projections adapted to deform upon coupling of the base to the adapter ring, another BOP component, or a portion thereof. A wiper can include a protrusion or other coupler, which can be coupled to a bottom surface or other portion of the base. The protrusion can be adapted to resist rotation of the base or wiper, such as in response to force applied to the first portion of the head in at least one direction. In at least one embodiment, a protrusion or other coupler can mate with a groove or other coupler of an adapter ring, in whole or in part.

A wiper can include a head or head portion, which can include a first, second or other side adapted to contact a surface or other portion of an adapter ring. A wiper can include a side or other portion that can intersects a base or other part of the wiper at an angle, such as an obtuse, acute or other angle. A wiper can include a head having two or more head portions, and one portion can be longer than another portion, such as across a major, minor or other cross-sectional dimension. A wiper can include a head or head portion adapted to elastically deform by less than 45 degrees. A wiper can include a head or head portion adapted to elastically deform by at least 45 degrees. A wiper can include a head or head portion adapted to elastically deform by at least 90 degrees. Rotation can be relative to a direction, such as horizontal or vertical, or can be relative to one or more other portions of a wiper, such as a base, or component to which a wiper can be coupled. A wiper can have a head, which can have proximal and distal sides relative to a base, and one or more portions of the head can collectively form an arcuate, curved or other surface on the distal side of the head, the proximal side of the head, or a combination thereof.

In at least one embodiment, an annular blowout preventer can include an adapter ring having an interior wall, a piston having an exterior wall and being slideable relative to the adapter ring along an interface between the interior wall of the adapter ring and the exterior wall of the piston, a pressure seal disposed along the interface fluidicly between a bore chamber and a hydraulic fluid chamber, and a wiper disposed within the bore chamber. The wiper can include can include a base adapted to couple the wiper to the adapter ring and a head coupled to the base. The head can include a first portion adapted to bridge the interface and contact the piston and a second portion adapted to contact an inner or other surface of the adapter ring. The second portion of the head can be adapted to at least partially resist rotation of the base when force can be applied to the first portion of the head in at least one direction, and the first portion of the head can be adapted to wipe the piston when the piston slides relative to the adapter ring.

An annular blowout preventer can include a wall of the adapter ring and a wall of the piston separated by a first distance along a first interface portion and a second distance along a second interface portion. The second distance can be greater than the first distance. A wiper head can include a tip or other portion adapted to wipe a piston along the second interface portion and another portion or surface adapted to wipe the piston along the first interface portion. A piston can be slideable relative to an adapter ring between two or more positions, such as a fully open position and a fully closed position, and a wiper head or portion thereof can be adapted to fold when the piston moves among one or more positions. An annular blowout preventer can include an interface portion wherein adjacent walls or other portions of components are parallel and an interface portion wherein the walls or other portions diverge from one another. A portion of a wiper head can be adapted to maintain contact with one or more components, such as a piston, along both interface portions, such as first, second, third, fourth or other interface portions. An annular blowout preventer can include a wiper having a cross-sectional dimension or area greater than a cross-sectional dimension or area of a pressure seal, wear pad or other wear component.

In at least one embodiment, an annular blowout preventer can include an interior wall of the adapter ring and an exterior wall of the piston separated by a distance along an interface portion of an interface and separated by another distance along another interface portion of the interface. One distance can be greater than the other distance. A pressure seal, which can include a portion thereof, can have a size, shape, length, area, volume, width, height, thickness or other dimension(s), in whole or in part, sufficient to partially or fully fluidicly or otherwise seal one chamber from another chamber along one interface portion and insufficient to seal one chamber from another chamber along another interface portion. A wiper, which can include a portion thereof, can have a size, shape, length, area, volume, width, height, thickness or other dimension(s), in whole or in part, sufficient to partially or fully fluidicly or otherwise seal one chamber from another chamber along one or more interface portions, which can include one or more interface portions along which a pressure seal or other wear component (e.g., a wear pad) cannot seal between or otherwise contact two or more adjacent components of a BOP.

In at least one embodiment, a wiper can comprise a protrusion adapted to mate with a groove of an adapter ring or other structure. A wiper can comprise one or more projections adapted to deform upon coupling of the wiper to an adapter ring, piston, component, structure, or a coupler of any of them. In at least one embodiment, force can be applied to a first portion of a wiper head, such as when a piston or other component slides relative to the wiper or when the wiper moves relative to a piston or other component, and a second portion of the wiper head can transfer or be adapted to transfer at least a portion of the force to a wall or other portion of one or more BOP components, such as when relative movement occurs such that force is applied to the wiper in one or more directions. One portion of a wiper can transfer or be adapted to transfer force applied to another portion of a wiper. In at least one embodiment, force can be applied to a first portion of a head, such as when a piston moves relative to a wiper, and a second portion of the head can be adapted to transfer at least a portion of the force to a structure, such as a wall of an adapter ring, which can include when the piston slides relative to the wiper in at least one direction. A piston can include a surface that diverges from a component, such as along a portion of an interface, and at least a portion of a wiper head can be adapted to wipe or otherwise contact at least a portion of the diverging surface.

In at least one embodiment, an annular blowout preventer can include a stationary component, a piston slideable relative to the stationary component, such as along an interface, and a wear component disposed along an interface fluidicly or otherwise between one chamber and another chamber, such as a bore chamber and a hydraulic or other fluid chamber, and a wiper disposed at least partially within one or more of the chambers. In at least one embodiment, the wiper can include a base coupled to the stationary component and a head coupled to the base, which can include being formed integrally with one another. The head can include a portion adapted to bridge an interface and contact the piston and a second portion adapted to contact a wall or other portion of the stationary component. The second portion of the head can be adapted to at least partially resist rotation of the base, such as when force is applied to the first portion of the head in at least one direction, or in more than one direction. The first portion of the head, separately or in combination with another portion(s) of the wiper, can be adapted to wipe at least a portion of the piston, such as when the piston moves relative to the stationary component.

Other and further embodiments utilizing one or more aspects of the embodiments described above can be devised without departing from the scope of the present disclosure. Further, the various methods and embodiments of the disclosure can be included in combination with each other to produce variations of the disclosed methods and embodiments. Discussion of singular elements can include plural elements and vice-versa. The order of steps can occur in a variety of sequences unless otherwise specifically limited. The various steps described herein can be combined with other steps, interlineated with the stated steps and/or split into multiple steps. Similarly, elements have been described functionally and can be embodied as separate components or can be combined into components having multiple functions.

The systems and methods have been described in the context of preferred and other embodiments and not every embodiment of the disclosure has been described. Obvious modifications and alterations to the described embodiments are available to those of ordinary skill in the art. The disclosed and undisclosed embodiments are not intended to limit or restrict the scope or applicability of the disclosure, but rather, in conformity with the patent laws, Applicant(s) intends to fully protect all such embodiments, modifications and improvements that come within the scope or range of equivalent of the following claims.

What is claimed is:

1. A wiper for an annular blowout preventer having an adapter ring and a piston slideable relative to the adapter ring along an interface, the wiper comprising:

a base adapted to couple the wiper to the adapter ring; and a head coupled to the base;

wherein the head includes a first portion adapted to bridge the interface and contact the piston and a second portion adapted to contact a surface of the adapter ring;

wherein the second portion of the head is adapted to bias the first portion of the head toward the piston;

wherein the first portion of the head is adapted to wipe the piston when the piston slides relative to the adapter ring; and wherein a length of the first portion of the head extending outward from the base is greater than a length of the second portion of the head extending outward from the base, and wherein the second portion of the head includes a first side that intersects the base at an angle that is either obtuse or acute.

2. The wiper of claim 1, wherein the base is adapted to couple with an annular peripheral groove of the adapter ring and wherein the base further comprises a plurality of projections adapted to deform upon coupling of the base to the adapter ring.

3. The wiper of claim 1, further comprising a protrusion coupled to a bottom surface of the base, wherein the protrusion is adapted to resist rotation of the base when force is applied to the first portion of the head in at least one direction.

4. The wiper of claim 3, wherein the protrusion mates with a groove of the adapter ring.

5. The wiper of claim 1, wherein the first side of the second portion of the head is adapted to contact the surface of the adapter ring.

6. The wiper of claim 1, wherein the first portion of the head is adapted to elastically deform by at least 45 degrees relative to the base.

7. The wiper of claim 1, wherein the first portion of the head is adapted to elastically deform by at least 90 degrees relative to the base.

8. The wiper of claim 1, wherein the head has proximal and distal sides relative to the base, and wherein the first and second portions of the head collectively form an arcuate surface on the distal side of the head.

9. The wiper of claim 1, wherein the second portion of the head is adapted to at least partially resist rotation of the base when force is applied to the first portion of the head in at least one direction.

10. The wiper of claim 1, wherein the second portion of the head is adapted to at least partially resist separation of the first portion of the head from the piston when force is applied to the first portion in at least one direction.

11. An annular blowout preventer, comprising:

an adapter ring having an interior wall;

a piston having an exterior wall and being slideable relative to the adapter ring along an interface between the interior wall of the adapter ring and the exterior wall of the piston;

a pressure seal disposed along the interface fluidicly between a bore chamber and a hydraulic fluid chamber; and a wiper disposed within the bore chamber, the wiper comprising a base coupled to the adapter ring; and a head coupled to the base;

wherein the head includes a first portion adapted to bridge the interface and contact the piston and a second portion adapted to contact the interior wall of the adapter ring;

wherein the second portion of the head is adapted to bias the first portion of the head toward the piston;

wherein the first portion of the head is adapted to wipe the piston when the piston slides relative to the adapter ring; and wherein a length of the first portion of the head extending outward from the base is greater than a length of the second portion of the head extending outward from the base, and wherein the second portion of the head includes a first side that intersects the base at an angle that is either obtuse or acute.

12. The annular blowout preventer of claim 11, further comprising:

wherein the interior wall of the adapter ring and the exterior wall of the piston are separated by a first distance along a first interface portion of the interface and are separated by a second distance along a second interface portion of the interface, the second distance being greater than the first distance;

wherein the first portion of the head includes a tip adapted to wipe the piston along the second interface portion; and wherein the first portion of the head includes a bottom surface adapted to wipe the piston along the first interface portion.

13. The annular blowout preventer of claim 11, wherein the piston is slideable relative to the adapter ring between a fully open position and a fully closed position, and wherein the first portion of the head of the wiper is adapted to fold when the piston moves from the fully open position to the fully closed position.

14. The annular blowout preventer of claim 11, further comprising:

a first interface portion wherein the interior wall of the adapter ring and the exterior wall of the piston are parallel; and a second interface portion wherein the exterior wall of the piston diverges from the interior wall of the adapter ring;

wherein the first portion of the head of the wiper is adapted to maintain contact with the piston along both the first interface portion and the second interface portion.

15. The annular blowout preventer of claim 11, wherein the wiper has a cross-sectional dimension that is greater than a cross-sectional dimension of the pressure seal.

16. The annular blowout preventer of claim 11, further comprising:

wherein the interior wall of the adapter ring and the exterior wall of the piston are separated by a first distance along a first interface portion of the interface and are separated by a second distance along a second interface portion of the interface, the second distance being greater than the first distance;

wherein the pressure seal is of a size sufficient to fluidicly seal the bore chamber from the hydraulic fluid chamber along the first interface portion and insufficient to fluidicly seal the bore chamber from the hydraulic fluid chamber along the second interface portion; and wherein the wiper is of a size sufficient to at least partially seal the bore chamber from the hydraulic fluid chamber along the second interface portion.

17. The annular blowout preventer of claim 11, wherein the wiper further comprises a protrusion adapted to mate with a groove of the adapter ring.

18. The annular blowout preventer of claim 11, wherein the wiper is adapted to couple with a groove of the adapter ring and further comprises a plurality of projections adapted to deform upon coupling of the wiper to the adapter ring.

19. The annular blowout preventer of claim 11, wherein force is applied to the first portion of the head when the piston slides relative to the wiper, and wherein the second portion of the head is adapted to transfer at least a portion of the force to the interior wall of the adapter ring when the piston slides relative to the wiper in at least one direction.

20. The annular blowout preventer of claim 11, wherein the piston includes a peripheral surface that diverges from the adapter ring along a portion of the interface, and wherein the first portion of the head is adapted to wipe the peripheral surface.

21. An annular blowout preventer, comprising:

a stationary component;

a piston slideable relative to the stationary component along an interface;

a pressure seal disposed along the interface fluidicly between a bore chamber and a hydraulic fluid chamber; and a wiper disposed within the bore chamber, the wiper comprising a base coupled to the stationary component; and a head coupled to the base;

wherein the head includes a first portion adapted to bridge the interface and contact the piston and a second portion adapted to contact a wall of the stationary component;

wherein the second portion of the head is adapted to bias the first portion of the head toward the piston; and wherein the first portion of the head is adapted to wipe at least a portion of the piston when the piston moves relative to the stationary component; and wherein a length of the first portion of the head extending outward from the base is greater than a length of the second portion of the head extending outward from the base, and wherein the second portion of the head includes a first side that intersects the base at an angle that is either obtuse or acute.

* * * * *